United States Patent [19]

Park et al.

[11] Patent Number: 4,561,557

[45] Date of Patent: Dec. 31, 1985

[54] BEVERAGE CONTAINER WITH A SANITARY DRINKING SPOUT

[76] Inventors: Sea C. Park; In P. Park, both of 3836 Birchwood, Skokie, Ill. 60076

[21] Appl. No.: 670,893

[22] Filed: Nov. 13, 1984

[51] Int. Cl.[4] ..... B65D 41/32

[52] U.S. Cl. ..... 220/90.2; 220/90.6; 229/7 R; 222/531; 222/541

[58] Field of Search ..... 220/90.2, 90.6, 85 SP; 229/7 R, 17 R; 222/531, 541

[56] References Cited

U.S. PATENT DOCUMENTS

| | | | |
|---|---|---|---|
| 2,069,738 | 2/1937 | Buchen | 229/7 R |
| 3,087,657 | 4/1963 | Eckles | 229/7 R X |
| 3,429,478 | 2/1969 | Ward | 220/90.2 |
| 3,923,193 | 12/1975 | Wells et al. | 220/90.6 X |
| 3,980,214 | 9/1976 | Dahlquist | 229/7 R X |
| 4,424,913 | 1/1984 | Ko | 220/90.2 |

*Primary Examiner*—Steven M. Pollard

*Attorney, Agent, or Firm*—Birch, Stewart, Kolasch & Birch

[57] ABSTRACT

The present invention comprises a sanitary beverage container having an enclosed spout for drinking liquid such as beer, milk, soft drinks or vegetable juice. The spout is automatically released from the container when it is opened by pulling back the opening tab thereof. Thus, the user's lips and mouth can use the drinking spout without contacting the top or walls of the container while drinking the contents from the container, thereby avoiding contamination and bacteria frequently associated with the top and sides of the container.

6 Claims, 5 Drawing Figures

BEVERAGE CONTAINER WITH A SANITARY DRINKING SPOUT

BACKGROUND OF THE INVENTION

The present invention relates to a beverage container with an enclosed spout and more particularly to a beverage container containing a drinking spout which is disposed in the sealed container but is released from the container when it is opened.

Various proposals have been made for providing straws or tubes in containers such as metal cans containing carbonated or non-carbonated drinks, to provide a means for drawing the contents of the container into the mouth of a person without the necessity of upending or tipping the container and contacting the wall or walls of the container with the lips and mouth. These proposals have not heretofore been commercially successful for a number of reasons including the fact that the tubes or straws are not sufficiently self-supporting and thus it becomes unsanitary because the lips of the person inevitably touch the lid or walls of the container. Also, it is very difficult to drink the vegetable juice or carbonated liquids, for example, beer through a straw which seriously limits its use.

SUMMARY AND OBJECTS OF THE INVENTION

Accordingly, it is an object of the present invention to provide a beverage container having an enclosed spout for drinking liquids such as beer, vegetable juice, soft drinks and a like.

Another object of the present invention is to provide a beverage container with an enclosed spout which can be released from the container when it is opened.

It is a further object of the present invention to provide a beverage container with an enclosed spout which can be used without contacting the lips or the mouth with the container top or walls.

It is still another object of the present invention to provide a container having an enclosed spout which is economical to manufacture.

Yet another object of the present invention is to provide a beverage container with a pull-up spout that is simple and easy to use.

Still another object of the present invention is to provide a drinking spout which is free of contamination because it is sealed in the container prior to being used.

Numerous other objects and advantages of the present invention will become apparent from the following specification which, together with the accompanying drawings, describes and illustrates preferred embodiments of the present invention.

Briefly described, the present invention comprises a beverage container having an enclosed spout for drinking liquid such as beer, milk, soft drinks or vegetable juice.

The spout is automatically released from the container when the user opens the container by pulling back the pop-top opener thereof. Thus, the user's lips can use the drinking spout without contacting any other portion of the container, thereby avoiding contamination and bacteria frequently associated with the top and sides of the container.

BRIEF DESCRIPTION OF THE INVENTION

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
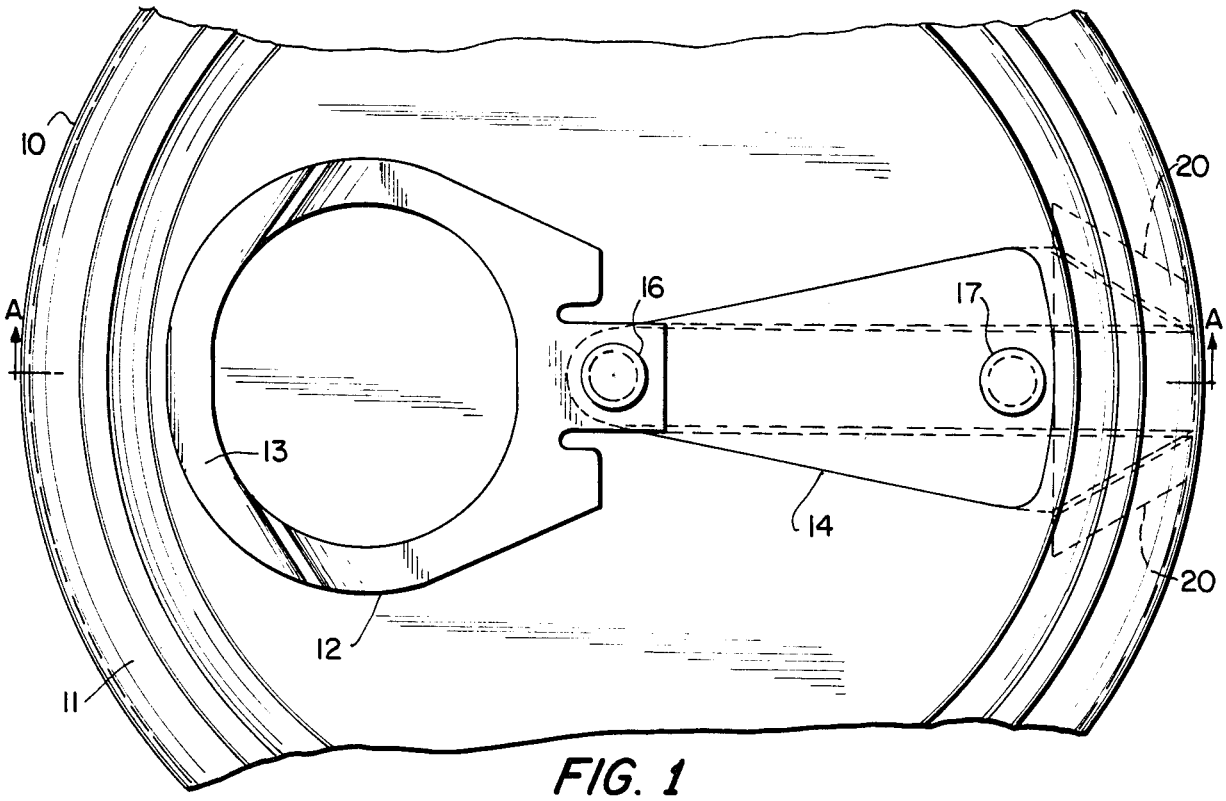
FIG. 1 is a top view of the beverage container with the enclosed spout of the present invention.
Figure 2:
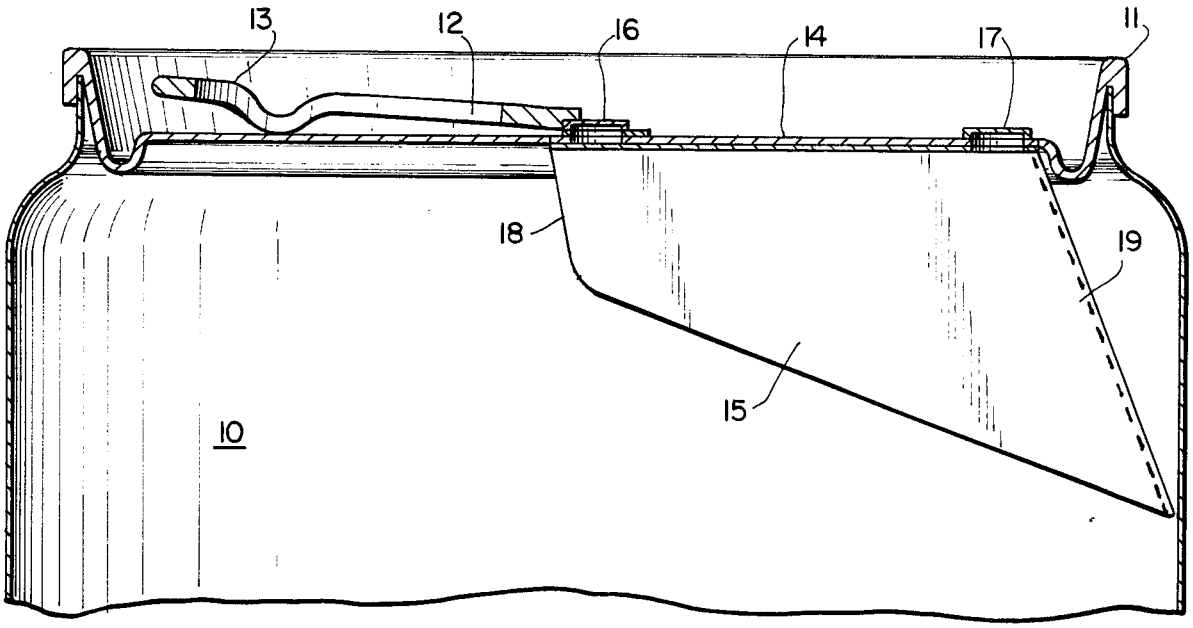
FIG. 2 is a cross-sectional view of the upper portion of the beverage container taken along the line A—A of FIG. 1.
Figure 5:
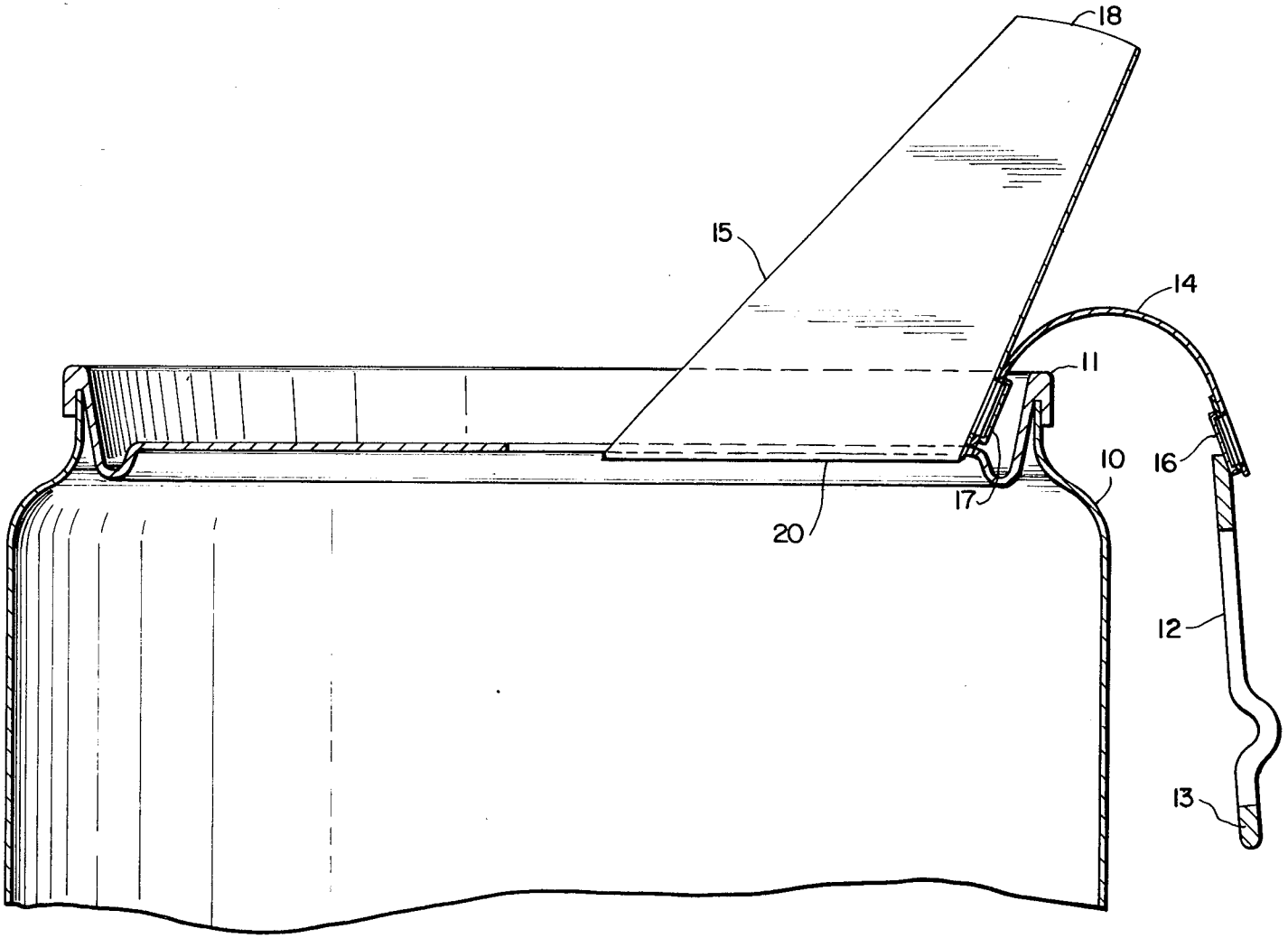
FIG. 5 is a cross-sectional side view of an opened upper portion of the container, taken along line B—B of FIG. 4.

Referring now in detail to the drawing for the purpose of illustrating the present invention, the beverage container 10 of the present invention as shown in FIGS. 1, 2 and 5 comprises a lid 11 of the container, an opener, for example, a pop-top opener 12, having a ring 13, a removable panel 14, and a spout 15 adjusted to the panel 14 by a rivet 17.

The removable panel 14 is linked to the ring 13 by a front rivet 16 which extends from the lid 11 of the container 10.

Figure 4:
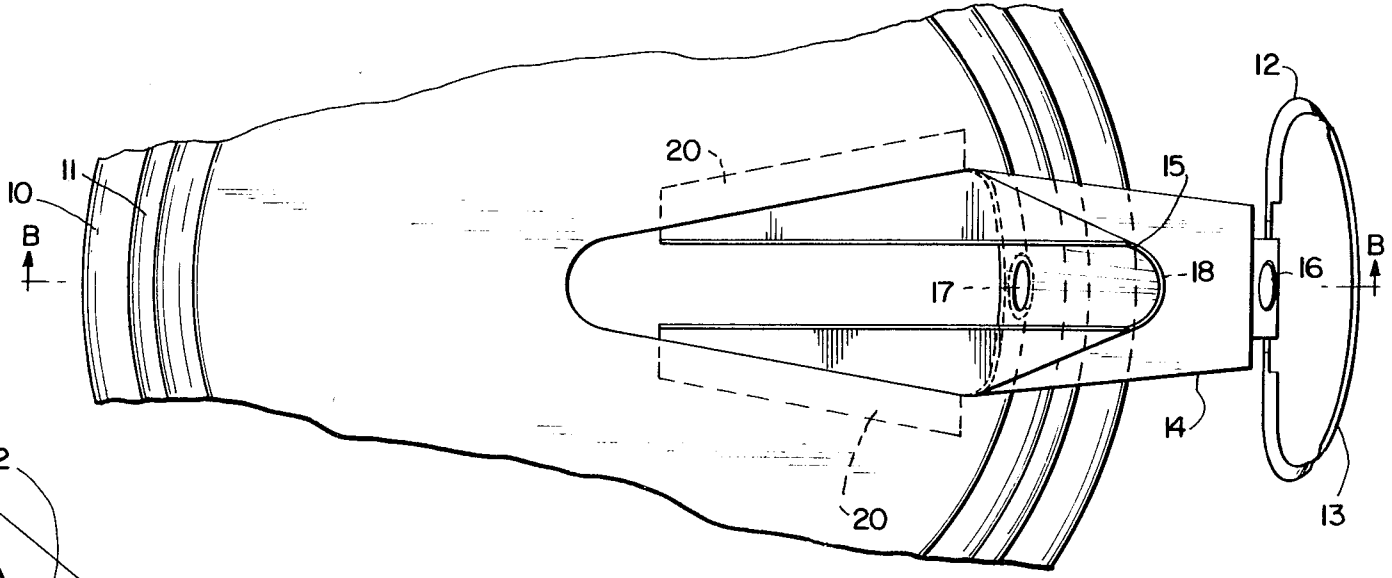
FIG. 4 is a top view showing the spout as it automatically is released from the container.
Figure 3:
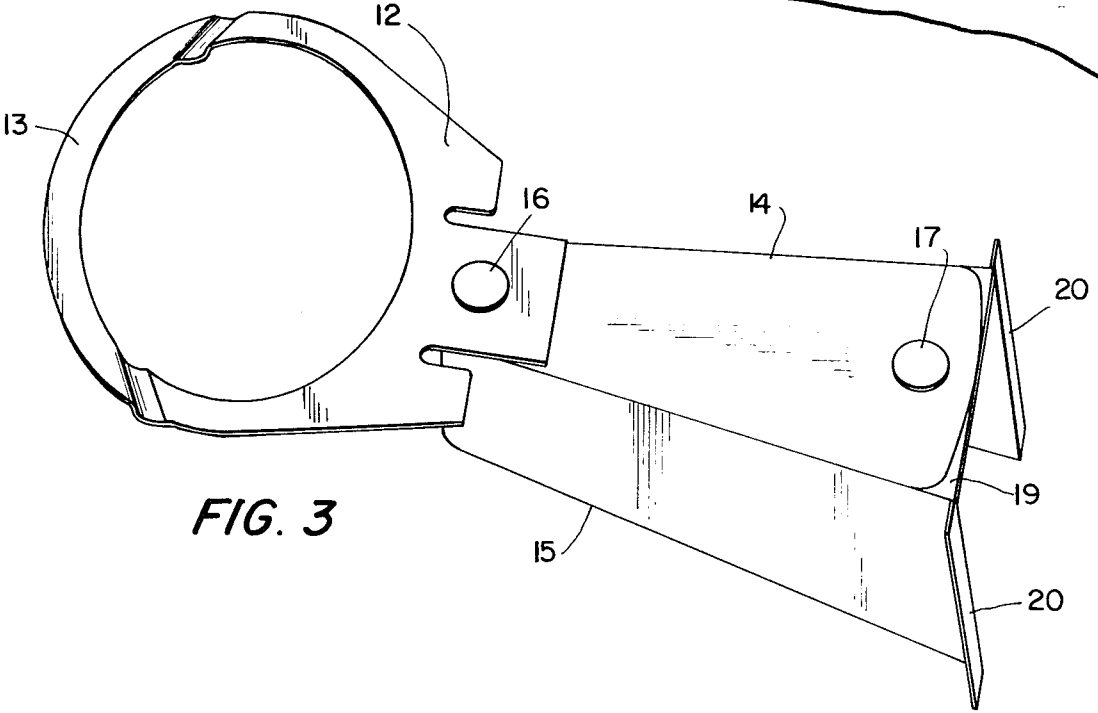
FIG. 3 is a perspective view of the opener and spout of the present invention.

The spout 15 as shown in FIGS. 3 and 4 comprises a narrow mouthpiece portion 18 which is adapated to be contacted by the lips of the user, and a wide portion 19 disposed at the other end of the spout having flange members 20. When the opener 12 is opened by pulling the ring 13 in the upward direction as shown in FIG. 4, the spout 15 is pulled from the container to the position as shown in FIG. 5. The opening of the container can be easily achieved because the narrow portion 18 of the panel 14 can be readily separated from the front rivet 16, whereas the wider end portion 19 is more securely attached by the rivet 17 to removable panel 14, as shown in FIG. 5. In its extended position, the spout stands obliquely and the ring 13 of the opener 12 is pulled down along the body of the container 10. The position of the spout 15 is determined by the flanges 20 which are adapted to engage with the inside and top portion of the container. Because of the position of the spout and the panel 14, the lips do not contact to the lid 11 of the container when drinking because the inner plate of the removable panel 14 prevents the mouth from touching the lid and walls of the container. Additionally, it is easy to discard the used container which contains the opener 12 and spout 15 by reversing the procedure and pushing the spout back into the container.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed:

1. A sanitary lid-drinking spout combination forming part of a beverage container which comprises:

a container top containing a removable panel position an opener attached to the outside surface of the lid at one end of the removable panel, and a drinking spout attached to the inside surface of the lid and extending along the surface of the removable panel, whereby when the opener is pulled to remove the panel portion from the container top, the drinking spout, which is attached to said panel portion is repositioned to extend above the surface of the lid, said opener being securely attached to the removable panel and the removable panel being, in turn, releasably attached to the drinking end of the drinking spout whereby upon the pulling of the opener, the removable panel is separated from the drinking end portion of the drinking spout to extend down along the side of the container, while remaining attached to the other end portion of the drinking spout.

2. The sanitary lid-drinking spout of claim 1, wherein the removable panel has wide and narrow end portions and the drinking spout has corresponding end portions and a substantially U-shaped configuration.

3. The sanitary lid-drinking spout of claim 2, wherein the narrow end portion of the drinking spout is the drinking end.

4. The sanitary lid-drinking spout of claim 1, wherein the opener is a pull ring.

5. The sanitary lid-drinking spout of claim 1 wherein the drinking spout is provided with lateral flanges which engage with the inside surface of the lid and limit the extent to which the drinking spout is repositioned above the surface of the lid.

6. The sanitary lid-drinking spout of claim 1, wherein the sanitary lid has a pop-top configuration.

* * * * *